US005878660A

United States Patent [19]

Takahashi et al.

[11] Patent Number: 5,878,660

[45] Date of Patent: Mar. 9, 1999

[54] STENCIL PRINTING DRUM WITH FRICTION REDUCING MEANS

[75] Inventors: Yasuhiro Takahashi; Katsuro Motoe; Hideo Negishi, all of Ibaraki-ken, Japan

[73] Assignee: Riso Kagaku Corporation, Tokyo, Japan

[21] Appl. No.: 916,282

[22] Filed: Aug. 22, 1997

Related U.S. Application Data

[63] Continuation-in-part of Ser. No. 507,915, Jul. 27, 1995, Pat. No. 5,660,107.

[30] Foreign Application Priority Data

Aug. 8, 1994 [JP] Japan ..... 6-185789
Jun. 30, 1995 [JP] Japan ..... 7-165897

[51] Int. Cl.[6] ..... B41L 13/10

[52] U.S. Cl. ..... 101/116; 101/127; 101/128.1

[58] Field of Search ..... 101/116, 120, 101/127, 127.1, 128.1

[56] References Cited

U.S. PATENT DOCUMENTS 4,911,069 3/1990 Hayama et al. ..... 101/120
5,060,567 10/1991 Hayama et al. ..... 101/120
5,090,312 2/1992 Ohinata ..... 101/116
5,247,882 9/1993 Zook et al. ..... 101/120
5,617,786 4/1997 Negishi ..... 101/116
5,660,107 8/1997 Takahashi et al. ..... 101/116
5,673,620 10/1997 Negishi et al. ..... 101/116

FOREIGN PATENT DOCUMENTS 242572 10/1987 Japan ..... 101/116

*Primary Examiner*—Stephen R. Funk
*Attorney, Agent, or Firm*—Kanesaka & Takeuchi

[57] ABSTRACT

A printing drum of a stencil printing machine is formed of a base member having two annular members spaced apart from each other and a transverse bar connecting the two annular members; a flexible multi-porous sheet having a filled portion at at least a part of a peripheral portion except a central portion thereof and being wrapped into a cylindrical shape around the outer peripheral surface of the base member, and around which a stencil sheet is wrapped; a spring member situated between one end of the flexible sheet and the base member to attach the flexible sheet resiliently on the base member; a stencil clamping device provided on the transverse bar for selectively clamping one end part of the stencil sheet; and an inner pressing device situated inside the flexible sheet for supplying ink outwardly. The inner pressing device pushes the flexible sheet radially outwardly when the base member and flexible sheet assembly rotates. Sliding areas are formed at portions of the annular members contacting the filling portion of the flexible multi-porous sheet. Thus, the flexible sheet can smoothly move on the annular members.

8 Claims, 9 Drawing Sheets

FIG, 9
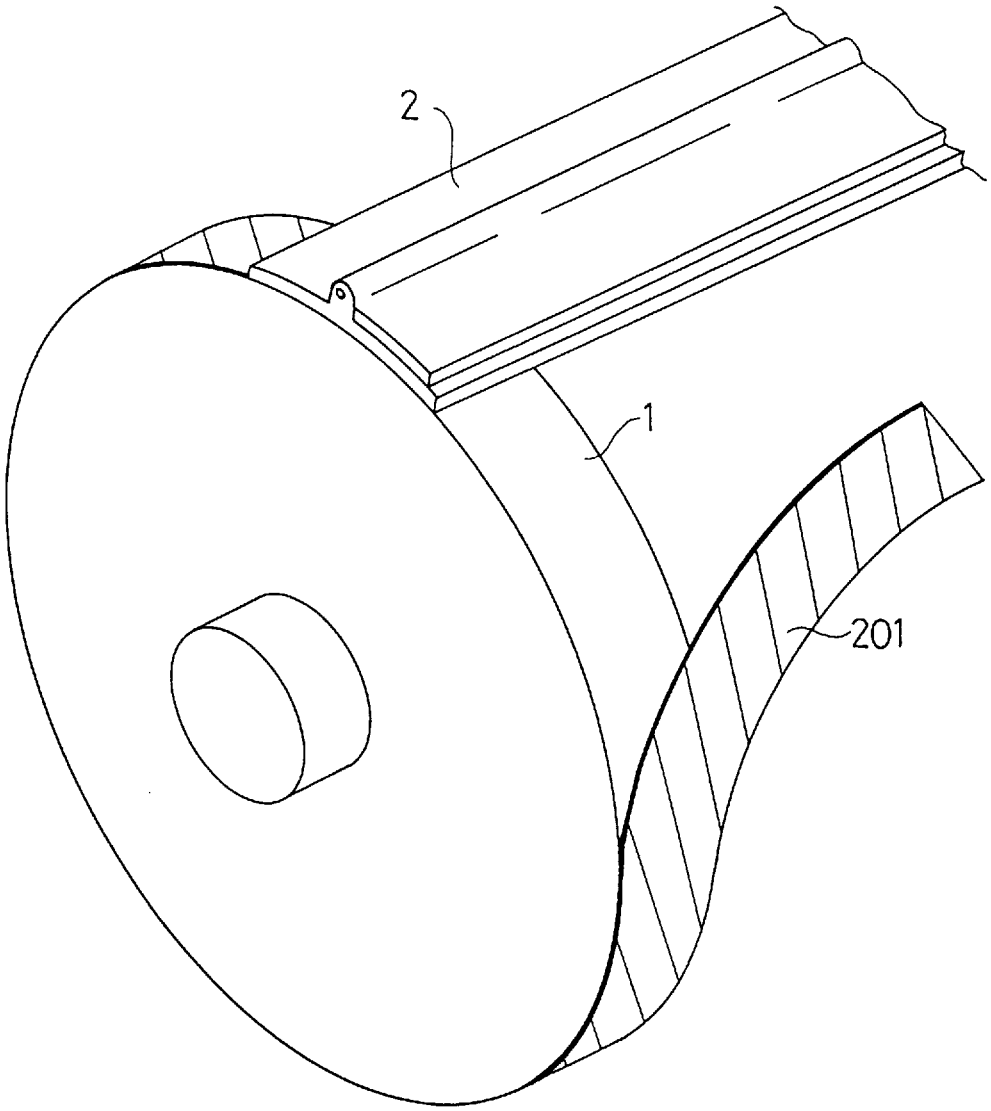

STENCIL PRINTING DRUM WITH FRICTION REDUCING MEANS

CROSS REFERENCE TO RELATED APPLICATION

This is a continuation in part application of Ser. No. 08/507,915 filed on Jul. 27, 1995, now U.S. Pat. No. 5,660,107.

BACKGROUND OF THE INVENTION

The present invention relates to a printing drum of a stencil printing machine.

As one example of stencil printing machines, a printing machine equipped with a multi-porous cylindrical printing drum rotatably supported on the central axis has been known, in which a perforated stencil sheet is wrapped around the printing drum, and ink is supplied from the inside of the printing drum to the outside of the printing drum, thus performing printing on printing paper pressed against the stencil sheet wrapped around the outer peripheral surface of the printing drum.

In the stencil printing machine with the basic construction described above, one having, more concretely, the following mechanism has been known. That is, a base member thereof is formed by connecting, by a transverse bar, two annular members disposed at a specific space on a common axis, and a flexible multi-porous sheet is wrapped in a cylindrical form around nearly the entire outside surface of the base member, thus constituting the printing drum of a cylindrical shape. The flexible multi-porous sheet is fastened at the leading edge part to one edge of the transverse bar and then, after being wrapped in a cylindrical form around the base member, it is elastically fixed at the tail edge part to the other edge of the transverse bar through a spring member. Therefore, the flexible multi-porous sheet is so wrapped and freely seated on the annular members as to be slidable in relation to the surface of the annular members along the direction of rotation of the printing drum.

Inside the printing drum are mounted an inner pressure roller and an ink supply device for supplying ink to the surface of the inner pressure roller. When the printing drum is rotated to perform printing, the flexible multi-porous sheet is expanded outwardly in a radial direction, to rotate the inner pressure roller along the inner peripheral surface of the flexible multi-porous sheet, thus supplying ink via the flexible multi-porous sheet and the stencil sheet. Outside the printing drum, a back press roller is mounted very closely to, but not in contact with, the printing drum, so that printing is done by transferring ink to printing paper inserted between the printing drum and the back press roller. The printing drum of the above-described structure has been disclosed, for example in Japanese Patent Application No. Hei 1-47029.

According to the stencil printing machine described above, printing is performed by radially outwardly expanding a part of the printing drum while rotating the inner pressure roller along the inner peripheral surface of the flexible multi-porous sheet, and by transferring ink to printing paper inserted between the expanded part and the back press roller. The tail edge of the flexible multi-porous sheet outwardly expanded by the inner pressure roller is pulled backwardly by the spring member in the direction of rotation of the printing drum along the outer peripheral surfaces of the annular members.

However, even when the flexible multi-porous sheet is freely seated on the outer peripheral surfaces of the annular members, considerable frictional resistance occurs in the circumferential direction of the annular members due to contact therebetween, preventing the inner pressure roller from smoothly pushing the flexible multi-porous sheet outwardly at the start of printing.

A frictional force in the circumferential direction of the annular members between the flexible multi-porous sheet and the annular members acts to prevent the inner pressure roller from pushing the flexible multi-porous sheet outwardly, resulting in an insufficient printing pressure applied to paper at the printing starting area of the printing drum which corresponds to the front part of the paper. Accordingly, it results in indistinct printing and further in an increased load to the inner pressure roller and a driving means thereof.

SUMMARY OF THE INVENTION

It is therefore an object of the present invention to provide a printing drum of a stencil printing machine in which a flexible multi-porous sheet is wrapped around a base member and is pushed out from inside by an inner pressure roller to perform printing, for the purpose of reducing an inner pressure roller load when the flexible multi-porous sheet is pushed out, thereby obtaining a uniform printed image.

The printing drum of a stencil printing machine according to a first aspect of the present invention comprises a base member having two annular members disposed at a specific space on a common central axis and a transverse bar connecting the two annular members; a flexible multi-porous sheet wrapped into a cylindrical shape around the outer peripheral surface of the base member, and around which a stencil sheet is wrapped, the multi-porous sheet having a filled portion around at least a part of a circumference thereof except a central portion; a spring member situated between an end of the flexible multi-porous sheet and the base member to attach the flexible multi-porous sheet resiliently on the base member; stencil clamping means provided on the transverse bar of the base member for selectively clamping one end part of the stencil sheet; inner pressing means provided on the inner side of the flexible multi-porous sheet for supplying ink outwardly from the inside of the flexible multi-porous sheet, and for radially outwardly deforming the flexible multi-porous sheet by pushing outwardly the inner peripheral surface of the flexible multi-porous sheet when the base member and flexible multi-porous sheet assembly rotate on the central axis stated above; and sliding areas formed on the annular members of the base member at portions contacting the filled portion of the flexible multi-porous sheet.

In the printing drum of the stencil printing machine according to a second aspect of the present invention, the printing drum is formed according to the first aspect, wherein the flexible multi-porous sheet includes a main portion formed by woven fibers, and a filling material filled in a part of the main portion. A part of the fibers for forming the main portion is exposed outwardly from the filling material at a surface of the filling portion contacting the base member.

In the printing drum of the stencil printing machine according to the third aspect of the present invention, the printing drum is formed according to the first aspect, wherein the sliding areas are formed by a sliding material coated onto the peripheral surfaces of the annular members.

In the printing drum of the stencil printing machine according to the fourth aspect of the present invention, the printing drum is formed according to the first aspect, wherein the sliding areas are formed by sliding members adhered onto the peripheral surfaces of the annular members.

In the printing drum of the stencil printing machine according to the fifth aspect of the present invention, the printing drum is formed according to the first aspect, wherein the sliding areas are obtained by a procedure smoothing the peripheral surfaces of the annular members.

In the printing drum of the stencil printing machine according to the sixth aspect of the present invention, the printing drum is formed according to the first aspect, wherein the sliding areas are formed by a super-hard material.

In the printing drum of the stencil printing machine according to the seventh aspect of the present invention, the printing drum is formed according to the first aspect, wherein the annular members are formed of a sliding material.

In the invention, when the inner pressing means contacts the inner peripheral surface of the flexible multi-porous sheet, the flexible multi-porous sheet deforms or is pushed outwardly in the radial direction. As the printing drum rotates, the flexible multi-porous sheet is partly deformed successively with rotation. After the inner pressing means moves away from the inner peripheral surface of the flexible multi-porous sheet, the flexible multi-porous sheet seats back in its former position. Since the annular members contacting the filling portion of the flexible multi-porous sheet are provided with sliding areas for reducing the frictional forces generated in the peripheral directions of the annular members between the flexible multi-porous sheet and each of the annular members, the load applied to the inner pressing means is decreased when the flexible multi-porous sheet is outwardly pushed or deformed.

The foregoing object and other objects, aspects and advantages of the printing drum according to the present invention will become more apparent from the following detailed description thereof, when read in connection with the accompanying drawings.

BRIEF DESCRIPTION OF THE DRAWINGS

FIG. 9 is a perspective view for showing a structure of an annular member of another embodiment of a printing drum.

DETAILED DESCRIPTION OF THE PREFERRED EMBODIMENT

Figure 1:
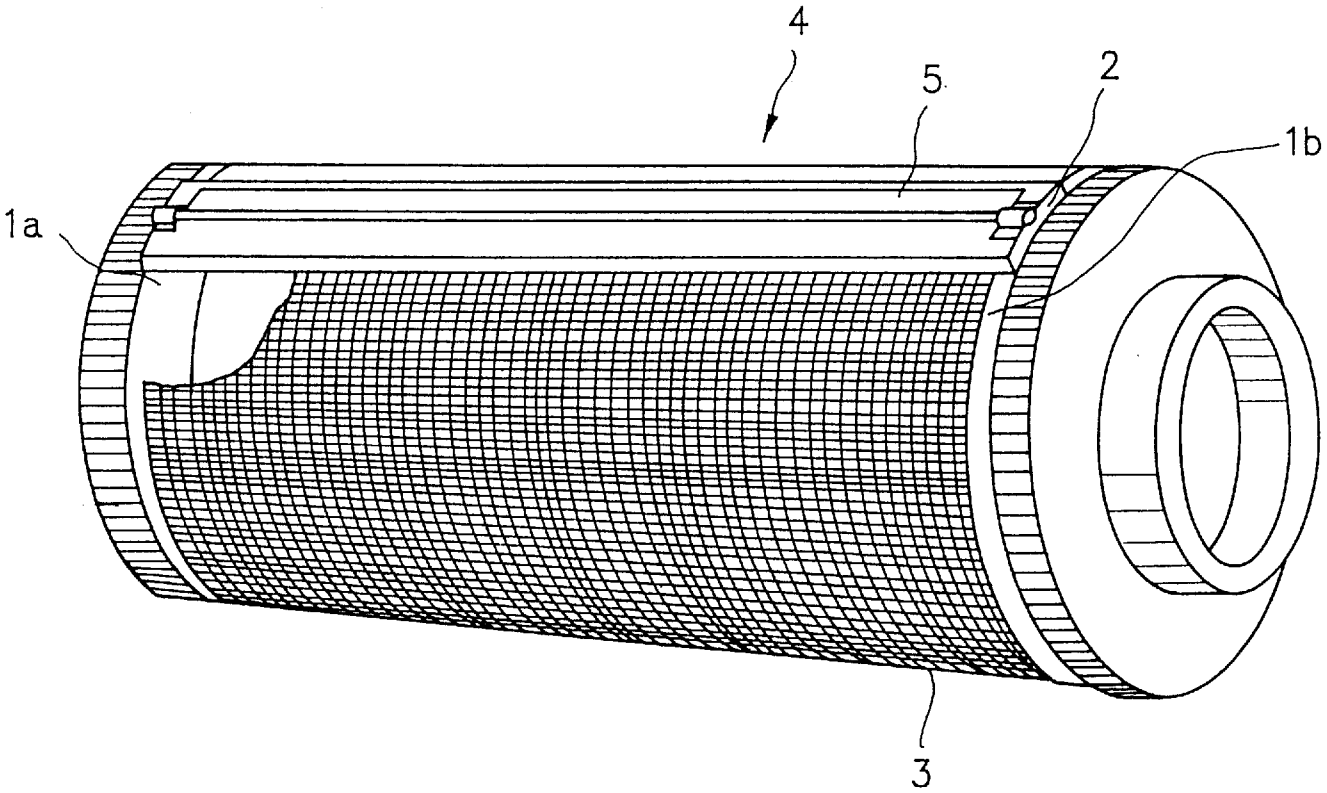
FIG. 1 is a perspective view of a printing drum of one embodiment of the invention.

One embodiment of a printing drum according to the present invention will now be explained with reference to the accompanying drawings. As shown in FIG. 1, two annular members 1*a* and 1*b* are arranged parallel at a specific space on the same rotating shaft as the central axis. These annular members 1*a* and 1*b* are connected by a transverse bar 2. The annular members 1*a* and 1*b* are each composed of a rigid solid body, such as plastics or metal. The transverse bar also is similarly composed of a rigid solid body. The annular members 1*a* and 1*b* and the transverse bar 2 may be formed as one unit. The transverse bar 2 is disposed in a direction along one base line of a printing drum 4, and is provided on the surface with stencil clamping means 5 for clamping the leading end of the stencil sheet. The annular members 1*a* and 1*b* and the transverse bar 2 constitute a base member which is the basic frame of the cylindrical printing drum 4.

Wrapped around the base member along the annular members 1*a* and 1*b* is a flexible multi-porous sheet 3 having a rectangular form when it is expanded or unfolded. The flexible multi-porous sheet 3 may be a screen produced of a woven or unwoven metal wire or netting, for example a screen made of stainless steel wires woven lengthwise and crosswise, or also a screen of such a synthetic resin fiber as polyester, polyethylene terephalate (TETORON) etc., or further a multi-porous plate having a multitude of fine pores. The flexible multi-porous sheet 3 may be produced of such a material that can withstand a specific pressure from the inside and outside of the printing drum 4, i.e. expanding outwardly in the radial direction of the printing drum 4 when it is applied with a pressure to be pushed at the time of printing and restoring the shape when the pressure is released. The screen made of a synthetic resin alone may be reinforced with stainless steel deposited by evaporation around the resin for the purpose of improving durability.

Figure 2:
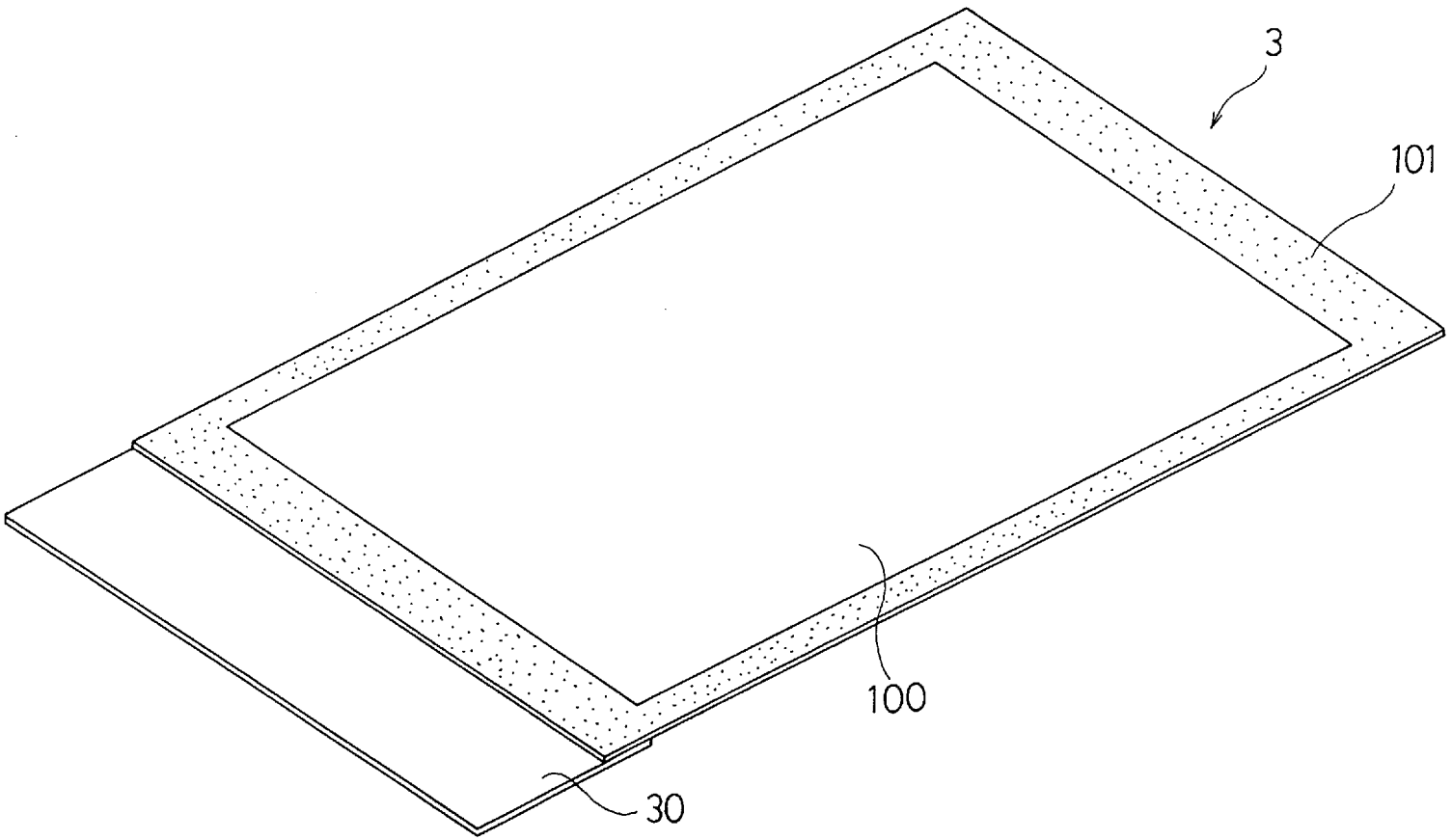
FIG. 2 is a perspective view of a flexible multi-porous sheet, which is unfolded.

As shown in FIG. 2, the multi-porous sheet 3 includes a central area 100 corresponding to a printing area, and a filled portion 101 in the form of a frame surrounding the central area 100. The filled portion 101 is a portion where the texture of the multi-porous sheet 3 is filled with silicone rubber and so on. As a method of filling the material, a squeezing is commonly used. A portion except the filled portion, i.e. printing area, is covered with a mask, and a filling material is applied by squeezing. The material may be urethane resin and so on in addition to silicone rubber. Preferably, the filling material can be easily applied by squeezing onto the multi-porous sheet and is hardened as time passes. After the filling procedure onto the multi-porous sheet is completed, the multi-porous sheet is formed into a cylindrical shape, so that preferably, the filling material does not become so hard. Ideally, it is preferable that the filling material has flexibility similar to the multi-porous sheet. Preferably, after the filling material is hardened, the filling material has about 30°–40° as hardness by a rubber hardness tester determined by JIS K6301.

Figure 3:
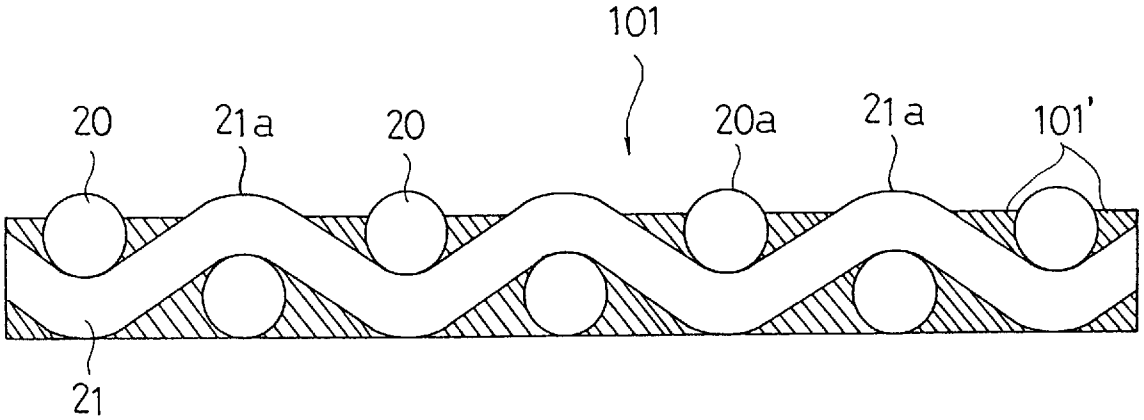
FIG. 3 is an enlarged sectional view of the flexible multi-porous sheet.

FIG. 3 shows an enlarged sectional view for the filled portion 101. The multi-porous sheet 3 is formed by weaving laterally and vertically plastic or metal wires, which includes warps 20 and wefts 21. At the sides of the filled portion 101 contacting the annular members 1*a*, 1*b*, the warps 20 and wefts 21 are slightly exposed over the upper surface of a filling (filled) material 101'. Thus, projecting portions 20*a*, 21*a* of the warps 20 and wefts 21 contact the annular members 1*a*, 1*b*. When the multi-porous sheet 3 moves relative to the annular members 1*a*, 1*b*, there is no influence due to the frictional resistance by the filling material 101'.

Figure 5:
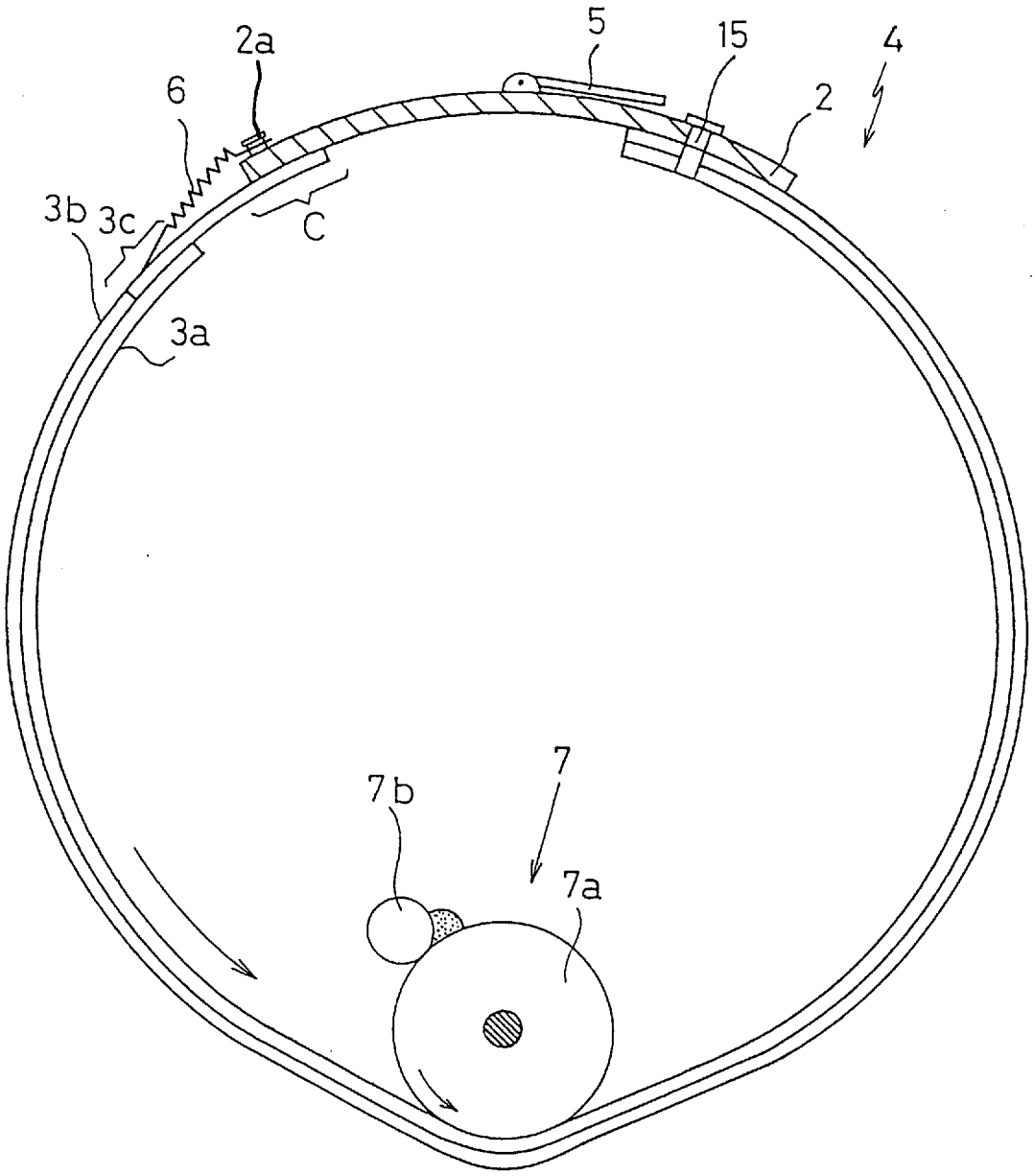
FIG. 5 is a sectional view of a printing drum of another embodiment of the invention.

Furthermore, a laminate of a plurality of flexible multi-porous sheets may be used. In FIG. 5, the annular members 1*a* and 1*b* are not illustrated. For an inner flexible multi-porous sheet 3*a,* a relatively rigid stainless steel wire screen or a multi-porous metal sheet provided with a multitude of fine pores is used, and also for an outer flexible multi-porous sheet 3*b,* a soft polyester screen deposited with stainless metal by evaporation is used. As regards the rate of holes of the flexible multi-porous sheet, it is preferable to provide the sheets with high mesh value (finer mesh) as it goes outwardly near to the stencil sheet, for the purpose of spreading out ink supplied from the inside of the printing drum 4. Furthermore, FIG. 5 shows the inner pressing roller 7*a,* which after contacting the inner peripheral surface of the flexible multi-porous sheet 3, has rotated as far as the position corresponding to the transverse bar with the rotation of the printing drum while continuously pushing the flexible multi-porous sheets outwardly in the radial direction.

Now, the filling of the material when a plurality of multi-porous sheets is laminated together is explained. The multi-porous sheets to be used are laminated, and in this condition, the filling material is applied by squeezing. After the filling material is hardened, the laminated multi-porous sheets closely contact together so that ink does not permeate or enter into a space therebetween. Therefore, phenomenon, such as flowing of ink from the end of the multi-porous sheets, e.g. end leakage, at the time of printing can be prevented.

Figure 6:
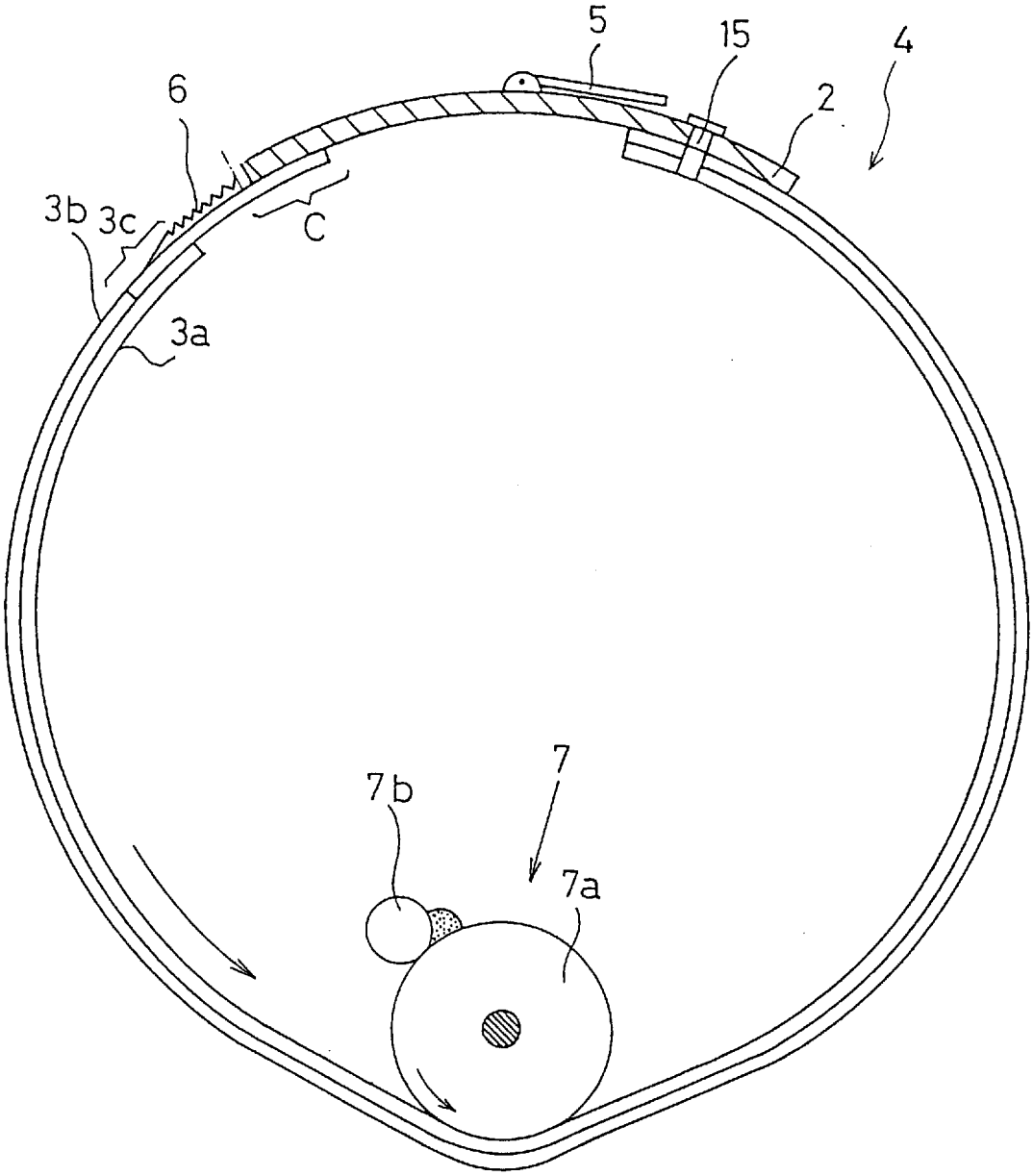
FIG. 6 is a sectional view of a printing drum of a still another embodiment of the invention.

The transverse bar 2 has a certain degree of width along the direction of rotation of the printing drum 4. On the delay side in the direction of rotation of the printing drum, the leading end of the flexible multi-porous sheet 3 is fastened by a fixing member 15. The leading end of the flexible multi-porous sheet 3 may be fastened directly to the transverse bar 2 and indirectly for example through a hinge. Furthermore, in FIG. 5, the leading end of the flexible multi-porous sheet 3 is located under the transverse bar 2, but may be fastened continuously integrally with the surface or edge of the transverse bar 2 and may be fastened in the vicinity of the transverse bar 2 on the external surface of the annular members 1 (1*a,* 1*b*). The flexible multi-porous sheet 3 is wrapped along the peripheral surfaces of the annular members 1*a* and 1*b* of the base member, with the tail end part thereof elastically fixed on the leading side in the direction of rotation of the transverse bar 2. As shown in FIG. 5, when the flexible multi-porous sheet 3 is composed of a plurality of sheets, only the tail end part of the outermost flexible multi-porous sheet 3*b* in contact with the stencil sheet is elastically fixed by a nail part 2*a* of the transverse bar 2 through a spring member 6. As shown in FIG. 6, the spring member 6 may be situated between the end of the flexible multi-porous sheet 3 and the annular members 1.

In FIG. 5, the outer and inner flexible multi-porous sheets 3*a* and 3*b* differ in length in order to prevent ink leakage at the tail end thereof, and the tail end of the outer flexible multi-porous sheet 3*b* is placed under the transverse bar 2, providing an overlap area C where a part of the flexible multi-porous sheet 3*b* and a part of the transverse bar 2 are overlapped.

Figure 4:
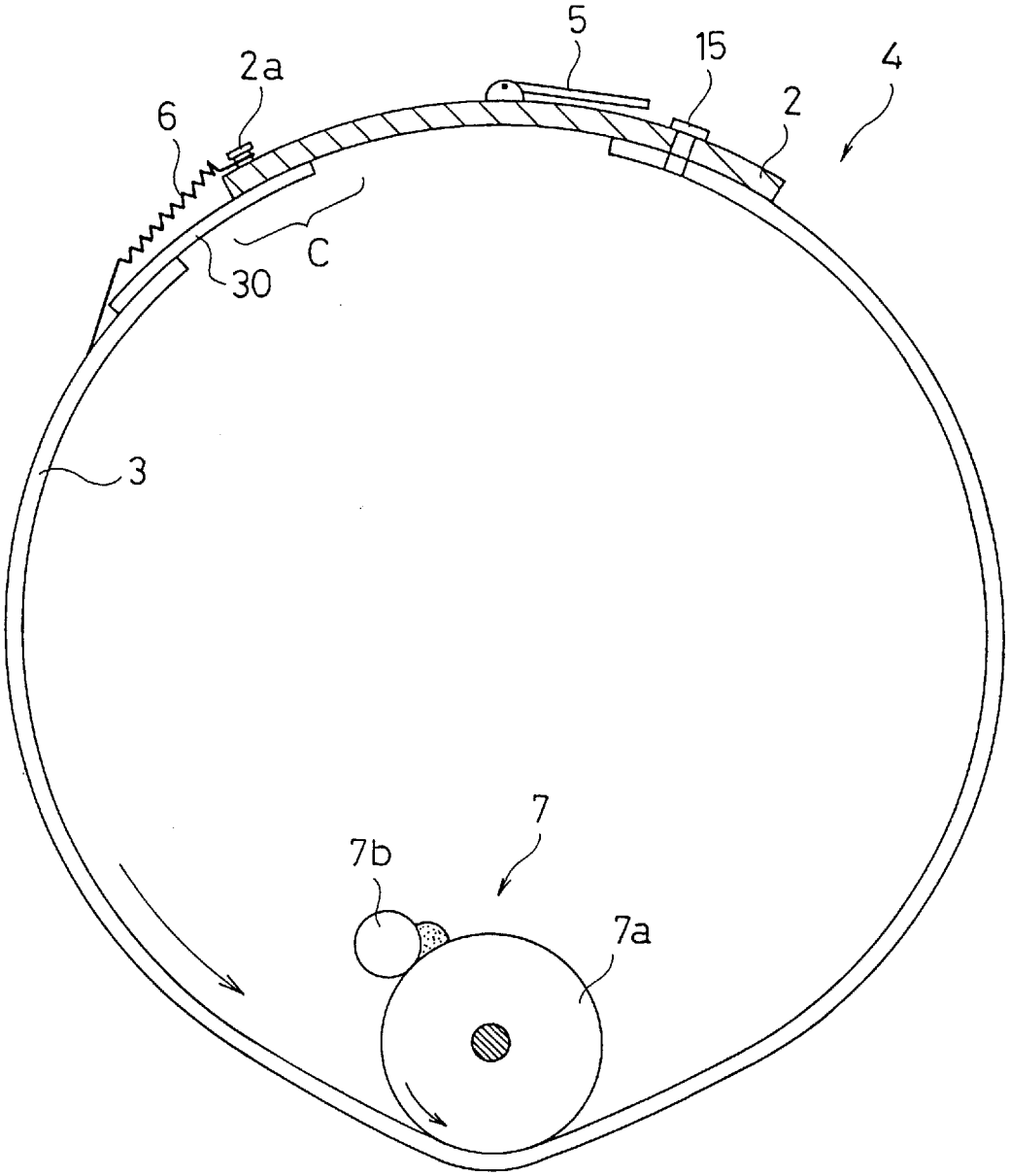
FIG. 4 is a sectional view of a printing drum of one embodiment of the invention.

In FIGS. 4, 5 and 6, ink supply means 7 for supplying ink is provided within the printing drum 4. An inner pressure roller 7*a* as the inner pressing means is rotated by a driving device (not illustrated) along the inner peripheral surface of the printing drum 4 (that is, the inner peripheral surface of the flexible multi-porous sheet 3) with the rotation of the printing drum 4, and off the inner peripheral surface of the printing drum 4 at the non-image part including the transverse bar 2. A doctor roller 7*b* is disposed very close to the inner pressure roller 7*a,* thereby controlling the thickness of an ink layer on the surface of the inner pressure roller 7*a* and accordingly moving together as one unit with the inner pressure roller 7*a*.

Figure 7A:
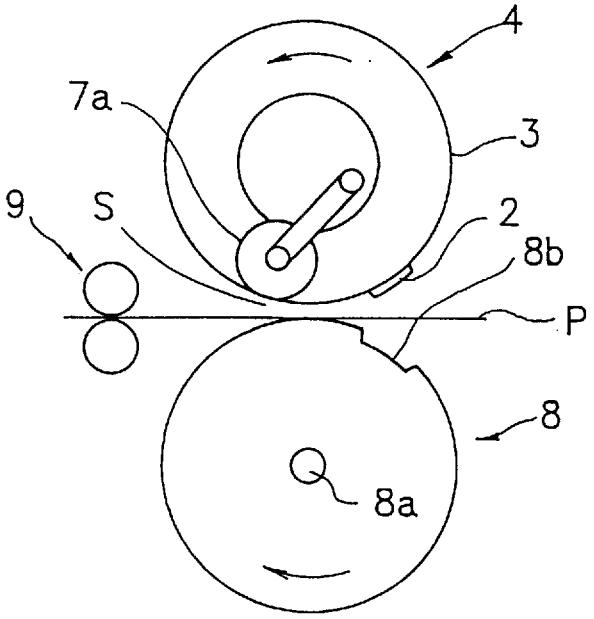
FIGS. 7(*a*) and 7(*b*) are views showing a printing operation of a stencil printing machine of one embodiment of the invention.
Figure 7B:
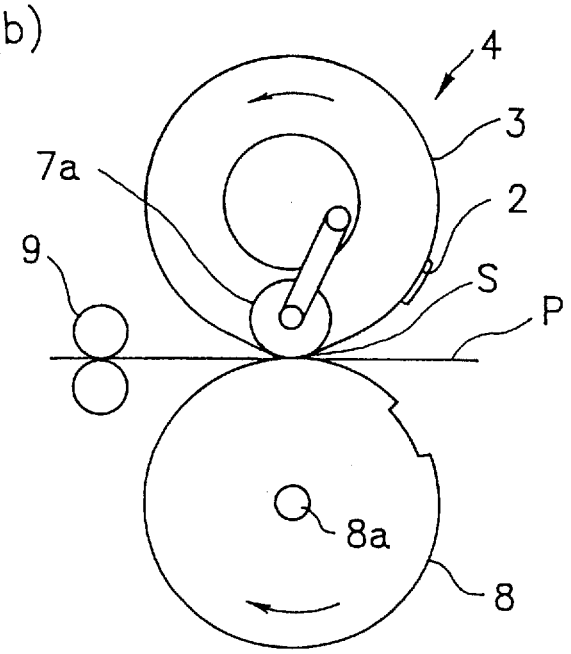

As shown in FIGS. 7(*a*) and 7(*b*), outside of the printing drum 4 is mounted the back press roller 8. The back press roller 8 is much the same in outside diameter as the printing drum 4, and is driven to rotate by the driving means not illustrated, on the center of a shaft 8*a* parallel with the rotating shaft of the printing drum 4 or to rotate simultaneously with the printing drum 4. The back press roller 8 is provided with a recessed section 8*b* in a part corresponding to the transverse bar 2 of the printing drum 4. The back press roller 8 rotates in the opposite direction simultaneously with the rotation of the printing drum 4 to hold together with the inner pressure roller 7*a* the paper P fed by a pair of paper feed rollers 9 to a small space S between the back press roller 8 and the printing drum 4, thus passing the paper from the left side to the right side in FIG. 7(*a*) to perform printing by transferring ink to the paper through the stencil sheet.

At this time, the inner pressure roller 7*a* rotating simultaneously with the rotation of the printing drum 4 deforms or pushes the flexible multi-porous sheet 3 outwardly at the front part in the direction of rotation of the printing drum 4 during the initial period of printing, to hold the paper P by the inner pressure roller 7*a* in the small space S between the printing drum 4 and the back press roller 8 as shown in FIG. 7(*b*), thus performing printing with ink transferred to the paper P.

There may be employed a mechanism for forcing to carry the paper P with the leading end thereof grasped with the nail part provided on the surface of the back press roller 8 at the time of printing. In this case, however, the back press roller may not be the same in diameter as the printing drum 4 and may be smaller in radius when printing is done with the paper P held simply between the printing drum 4 and the back press roller 8 as shown in FIG. 7(*b*).

Figure 8:
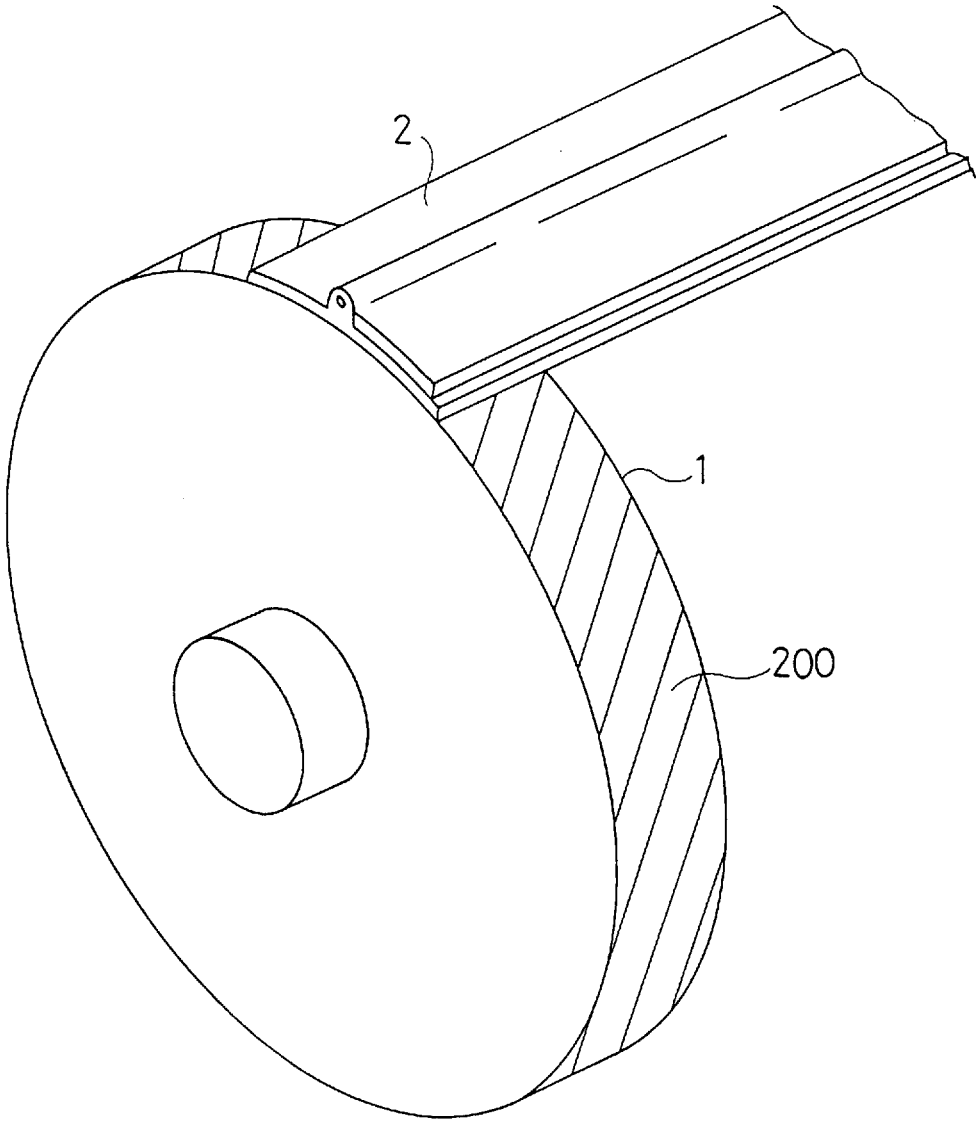
FIG. 8 is a perspective view for showing a structure of an annular member of a printing drum.

FIG. 8 shows the annular member 1, wherein the multi-porous sheet 3 is removed. The outer periphery of the annular member 1 contacting the multi-porous sheet 3 forms a sliding area 200 coated with fluorine resin or polyester resin. Resin in the form of a liquid hardens as time passes, and forms a thin layer on the outer periphery of the annular member 1. As the resin, polytetrafluoroethylene, polychlorotrifluoroethylene, polyfluorovinylidene, fluoro rubber, polyethylene terephthalate and so on may be used.

Further, a sliding material need not be directly coated on the annular member 1. As shown in FIG. 9, a tape 201 having a sliding ability, such as a tape where the resin as explained before is laminated onto a substrate made of a synthetic resin, polyethylene resin tape and so on, may be attached onto the entire outer periphery of the annular member 1.

Also, if it is periodically added, it is possible to coat a lubricant, such as silicone oil, on the outer periphery of the annular member 1. As a lubricant, it is possible to select any material as long as the filling material of the multi-porous sheet is not damaged.

In the above example, the sliding area is provided around the annular member 1 made of, for example aluminum, but it is possible to form the annular member itself by a sliding material. For example, the annular member may be made of polyoxymethylene (POM) plastic, ABS resin and so on.

At the time of printing, since the annular member 1 contacts the projecting portions 20*a* of the multi-porous sheet, the annular member 1 may wear and have a scratch. The damage may become a cause of a frictional resistance to prevent movement of the multi-porous sheet 3.

Therefore, on the outer surface of the annular member 1, a hard member harder than the multi-porous sheet 3 may be formed. For example, hard alumite in the strip form may be wrapped and fixed on the annular member 1. In addition, the annular member 1 may be hardened by applying chrome plating, nickel plating or nitriding processing. Also, the annular member itself may be formed of a hard material, for example nitriding steel.

As shown in FIG. 2, a polyester sheet 30 is attached to the tail end part of the flexible multi-porous sheet 3. The polyester sheet 30 is an ink-resisting sheet member having sliding ability. After an edge portion of the polyester sheet 30 is placed under the outer surface of the tail end part of the flexible multi-porous sheet 3, the filling material is applied on the inner surface of the flexible multi-porous sheet 3 by squeezing to form the filled portion 101. After the filling material is hardened, the polyester sheet 30 is attached closely to the flexible multi-porous sheet 3.

In FIG. 4, in order to prevent ink leakage, the tail end of the polyester sheet 30 of the flexible multi-porous sheet 3 is placed under the transverse bar 2, providing an overlap area C where a part of the polyester sheet 30 and a part of the transverse bar 2 are overlapped. There occurs only a small frictional resistance in the overlap area C since the polyester sheet 30 has sliding ability.

In FIG. 4, ink supply means for supplying ink is provided within the printing drum 4. An inner pressure roller 7*a* as the inner pressing means is rotated by a driving device (not illustrated) along the inner peripheral surface of the printing drum 4 (that is, the inner peripheral surface of the flexible multi-porous sheet 3) with the rotation of the printing drum 4, and off the inner peripheral surface of the printing drum 4 at the non-image part including the transverse bar 2. A doctor roller 7*b* is disposed very close to the inner pressure roller 7*a,* thereby controlling the thickness of an ink layer on the surface of the inner pressure roller 7*a* and accordingly moving together as one unit with the inner pressure roller 7*a*.

When printing is started, a perforated stencil sheet is wrapped around the outer peripheral surface of the printing drum 4. With the rotation of the printing drum 4, the inner pressure roller 7*a* is driven, by a driving device not shown, to rotate on the inner peripheral surface of the flexible multi-porous sheet 3, or to rotate together with the printing drum 4 along the inner peripheral surface of the printing drum 4. The flexible multi-porous sheet 3 on the printing drum 4 is continuously pressed outwardly by the inner pressure roller 7*a* while rotating with the rotation of the printing drum 4, starting with the front part in the direction of rotation of the printing drum 4.

The back press roller 8 rotates in the opposite direction simultaneously with the rotation of the printing drum 4, holding together with the inner pressure roller 7*a,* the paper P being fed by a pair of paper feed rollers 9 into a small space S between the printing drum 4 and the back press roller 8. Printing is done while moving the paper P from the left to the right in FIG. 7(*a*) and transferring ink to the paper through the stencil sheet.

Since there is provided the sliding area on the contact surface between the base member (the annular members 1 and the transverse bar 2) and the flexible multi-porous sheet 3 for the purpose of reducing the frictional resistance between them, the inner pressure 7*a* can smoothly push the flexible multi-porous sheet 3 outwardly during the initial period of printing.

The inner pressure roller 7*a,* in a proper timing with the rotation of the printing drum 4, moves away from the inner peripheral surface of the printing drum 4 so as not to press the non-image part including the transverse bar 2. After the inner pressure roller 7*a* has moved away from the inner peripheral surface of the printing drum 4, the flexible multi-porous sheet 3 is released from a holding force between the inner pressure roller 7*a* and the back press roller 8. The spring member 6 secured on the tail end part 3*c* of the flexible multi-porous sheet 3*b* pulls back the flexible multi-porous sheet 3 which has been deformed or pushed outwardly by the elastic force thereof.

The frictional resistance occurring between the base member (the annular members 1*a* and 1*b* and the transverse bar 2) and the flexible multi-porous sheet 3 during the operation described above will be explained in further detail. First, when the inner pressure roller 7*a* in contact with the inner peripheral surface of the printing drum 4 presses the printing drum 4 outwardly, the spring member 6 extends and at the same time the frictional resistance occurs between the base member and the flexible multi-porous sheet 3.

Thereafter, during the rotation of the printing drum 4, the amount of extension of the spring member 6 remains unchanged. Also, the flexible multi-porous sheet 3 remains outwardly deformed and there will not move circumferentially, so that there occurs no frictional resistance between the base member and the flexible multi-porous sheet 3.

At the very instant that the inner pressure roller 7*a* moves away from the inner peripheral surface of the printing drum 4, only the expanded area of the flexible multi-porous sheet 3 being pressed by the inner pressure roller 7*a* is released, and there occurs no frictional resistance between the annular members 1*a* and 1*b* and the flexible multi-porous sheet 3. This is because, in the present embodiment, the inner pressure roller 7*a* withdraws from the inner surface of the printing drum 4, in the vicinity of the tail end part of the flexible multi-porous sheet 3*a*.

However, when for example the inner pressure roller 7*a* is in a position shown in FIG. 5, if there has taken place any trouble with the printing machine or if an imaged area of the stencil sheet is over, it is possible to control the machine to move the inner pressure roller 7*a* away from the inner peripheral surface of the printing drum 4. In this case, the flexible multi-porous sheet is pulled back by the spring member 6 on the delay side (on the left side of the inner pressure roller 7*a* in FIG. 5) in the direction of rotation of the printing drum 4, causing a frictional resistance to occur between the flexible multi-porous sheet and the peripheral surface of each annular member.

In the overlap area C, the inner surface side of the transverse bar is in contact with the flexible multi-porous sheet 3. Therefore, there occurs a frictional resistance in the contact area at the instant the inner pressure roller 7*a* moves off the inner peripheral surface of the printing drum 4 regardless of the position where the inner pressure roller 7*a* comes off the inner peripheral surface of the printing drum 4. The inner surface side of the transverse bar may be provided with a sliding material in order to reduce the frictional resistance in the overlap area C.

According to the present apparatus, as heretofore explained, there takes place the frictional resistance in a contact area between the base member and the flexible multi-porous sheet which is on the delay side of the position of the inner pressure roller 7*a* in the direction of rotation of the printing drum, when the inner pressure roller 7*a* moves into contact with or away from the inner peripheral surface of the printing drum. The frictional resistance is reduced at the sliding area formed between the base member and the contact area of the multi-porous sheet.

The preferred embodiment of the present invention has been explained in detail but it is apparent to those skilled in the art that the scope of the present invention is not limited thereto and various applications and variations can be made.

In the printing drum of the stencil printing machine of the present invention, the flexible multi-porous sheet is elastically wrapped around the base member, and the sheet is pressed from inside by the inner pressing means to perform printing; and the sliding area is provided on the contact surface between the base member and the flexible multi-porous sheet, thereby reducing load applied to the inner pressure roller during pressing.

What is claimed is:

1. A printing drum of a stencil printing machine, comprising:

a base member having two annular members arranged on a common central axis and spaced at a predetermined distance away from each other, and a transverse bar connecting the two annular members;

a flexible multi-porous sheet formed of a main portion made of fibers, and a filling material filled in a part of the main portion, said flexible multi-porous sheet having a central portion and a filled portion filled by the filling material at at least a part of a periphery of the central portion, a part of the fibers for forming the main portion being exposed outwardly from the filling material at a surface of the filled portion contacting the base member, said flexible multi-porous sheet being fixed at one end to the base member and wrapped on an outer peripheral surface of said base member to make a cylindrical shape, a stencil sheet being adapted to be wrapped around an outer surface of the flexible multi-porous sheet;

a spring member situated between the other end of the flexible multi-porous sheet and the base member to attach the flexible multi-porous sheet resiliently on the base member;

stencil clamping means provided on the transverse bar of said base member adapted to selectively clamp one end part of the stencil sheet;

inner pressing means provided inside said flexible multi-porous sheet to supply ink outwardly from the inside of said flexible multi-porous sheet, said inner pressing means pushing an inner peripheral surface of the flexible multi-porous sheet to deform the sheet radially outwardly when said base member and said flexible multi-porous sheet are rotated on the central axis; and sliding areas formed on portions of the base member contacting the filled portion of the flexible multi-porous sheet, said sliding areas being formed of a resin in a form of a liquid as a sliding material coated onto peripheral surfaces of the annular members.

2. A printing drum of a stencil printing machine, comprising:

a base member having two annular members arranged on a common central axis and spaced at a predetermined distance away from each other, and a transverse bar connecting the two annular members;

a flexible multi-porous sheet formed of a main portion made of fibers, and a filling material filled in a part of the main portion, said flexible multi-porous sheet having a central portion and a filled portion filled by the filling material at at least a part of a periphery of the central portion, a part of the fibers for forming the main portion being exposed outwardly from the filling material at a surface of the filled portion contacting the base member, said flexible multi-porous sheet being fixed at one end to the base member and wrapped on an outer peripheral surface of said base member to make a cylindrical shape, a stencil sheet being adapted to be wrapped around an outer surface of the flexible multi-porous sheet;

a spring member situated between the other end of the flexible multi-porous sheet and the base member to attach the flexible multi-porous sheet resiliently on the base member;

stencil clamping means provided on the transverse bar of said base member adapted to selectively clamp one end part of the stencil sheet;

inner pressing means provided inside said flexible multi-porous sheet to supply ink outwardly from the inside of said flexible multi-porous sheet, said inner pressing means pushing an inner peripheral surface of the flexible multi-porous sheet to deform the sheet radially outwardly when said base member and said flexible multi-porous sheet are rotated on the central axis; and sliding areas formed on portions of the base member contacting the filled portion of the flexible multi-porous sheet, said sliding areas being formed of sliding members made of resin tapes adhered onto peripheral surfaces of the annular members.

3. A printing drum of a stencil printing machine, comprising:

a base member having two annular members arranged on a common central axis and spaced at a predetermined distance away from each other, and a transverse bar connecting the two annular members;

a flexible multi-porous sheet formed of a main portion made of fibers, and a filling material filled in a part of the main portion, said flexible multi-porous sheet having a central portion and a filled portion filled by the filling material at at least a part of a periphery of the central portion, a part of the fibers for forming the main portion being exposed outwardly from the filling material at a surface of the filled portion contacting the base member, said flexible multi-porous sheet being fixed at one end to the base member and wrapped on an outer peripheral surface of said base member to make a cylindrical shape, a stencil sheet being adapted to be wrapped around an outer surface of the flexible multi-porous sheet;

a spring member situated between the other end of the flexible multi-porous sheet and the base member to attach the flexible multi-porous sheet resiliently on the base member;

stencil clamping means provided on the transverse bar of said base member adapted to selectively clamp one end part of the stencil sheet;

inner pressing means provided inside said flexible multi-porous sheet to supply ink outwardly from the inside of said flexible multi-porous sheet, said inner pressing means pushing an inner peripheral surface of the flexible multi-porous sheet to deform the sheet radially outwardly when said base member and said flexible multi-porous sheet are rotated on the central axis; and sliding areas formed on portions of the base member contacting the filled portion of the flexible multi-porous sheet, said sliding areas being formed of plated metal so that the sliding areas are harder than the flexible multi-porous sheet.

4. A printing drum according to claim 3, wherein said annular members are plated to form the sliding areas.

5. A printing drum of a stencil printing machine, comprising:

a base member having two annular members arranged on a common central axis and spaced at a predetermined distance away from each other, and a transverse bar connecting the two annular members;

a flexible multi-porous sheet formed of a main portion made of fibers, and a filling material filled in a part of the main portion, said flexible multi-porous sheet having a central portion and a filled portion filled by the filling material at at least a part of a periphery of the central portion, a part of the fibers for forming the main portion being exposed outwardly from the filling material at a surface of the filled portion contacting the base member, said flexible multi-porous sheet being fixed at one end to the base member and wrapped on an outer peripheral surface of said base member to make a cylindrical shape, a stencil sheet being adapted to be wrapped around an outer surface of the flexible multi-porous sheet;

a spring member situated between the other end of the flexible multi-porous sheet and the base member to attach the flexible multi-porous sheet resiliently on the base member;

stencil clamping means provided on the transverse bar of said base member adapted to selectively clamp one end part of the stencil sheet;

inner pressing means provided inside said flexible multi-porous sheet to supply ink outwardly from the inside of said flexible multi-porous sheet, said inner pressing means pushing an inner peripheral surface of the flexible multi-porous sheet to deform the sheet radially outwardly when said base member and said flexible multi-porous sheet are rotated on the central axis; and sliding areas formed on portions of the base member contacting the filled portion of the flexible multi-porous sheet, said sliding areas being formed of nitrided materials so that the sliding areas are harder than the flexible multi-porous sheet.

6. A printing drum according to claim 5, wherein said annular members are partially nitrided to form the sliding areas.

7. A printing drum of a stencil printing machine, comprising:

a base member having two annular members arranged on a common central axis and spaced at a predetermined distance away from each other, said annular members being formed of a sliding material made of a resin, and a transverse bar connecting the two annular members;

a flexible multi-porous sheet formed of a main portion made of fibers, and a filling material filled in a part of the main portion, said flexible multi-porous sheet having a central portion and a filled portion filled by the filling material at at least a part of a periphery of the central portion, a part of the fibers for forming the main portion being exposed outwardly from the filling material at a surface of the filled portion contacting the base member, said flexible multi-porous sheet being fixed at one end to the base member and wrapped on an outer peripheral surface of said base member to make a cylindrical shape, a stencil sheet being adapted to be wrapped around an outer surface of the flexible multi-porous sheet;

a spring member situated between the other end of the flexible multi-porous sheet and the base member to attach the flexible multi-porous sheet resiliently on the base member;

stencil clamping means provided on the transverse bar of said base member adapted to selectively clamp one end part of the stencil sheet;

inner pressing means provided inside said flexible multi-porous sheet to supply ink outwardly from the inside of said flexible multi-porous sheet, said inner pressing means pushing an inner peripheral surface of the flexible multi-porous sheet to deform the sheet radially outwardly when said base member and said flexible multi-porous sheet are rotated on the central axis; and sliding areas formed on portions of the base member contacting the filled portion of the flexible multi-porous sheet.

8. A printing drum according to claim 7, wherein said annular members form the sliding areas.

* * * * *